US009010136B2

(12) United States Patent
Meister

(10) Patent No.: US 9,010,136 B2
(45) Date of Patent: Apr. 21, 2015

(54) METHOD OF OBTAINING STABLE CONDITIONS FOR THE EVAPORATION TEMPERATURE OF A MEDIA TO BE COOLED THROUGH EVAPORATION IN A REFRIGERATING INSTALLATION

(75) Inventor: Remo Meister, Merligen (CH)

(73) Assignee: BMS-Energietechnik AG, Wilderswil (CH)

( * ) Notice: Subject to any disclaimer, the term of this patent is extended or adjusted under 35 U.S.C. 154(b) by 1475 days.

(21) Appl. No.: 10/587,741

(22) PCT Filed: Jan. 28, 2004

(86) PCT No.: PCT/CH2004/000046

§ 371 (c)(1),
(2), (4) Date: Jul. 27, 2006

(87) PCT Pub. No.: WO2005/073645

PCT Pub. Date: Aug. 11, 2005

(65) Prior Publication Data

US 2007/0137229 A1 Jun. 21, 2007

(51) Int. Cl.

| | |
|---|---|
| ***F25B 5/00*** | (2006.01) |
| ***F25B 5/04*** | (2006.01) |
| ***F25B 40/00*** | (2006.01) |
| ***F25B 41/06*** | (2006.01) |

(52) U.S. Cl.

CPC ... *F25B 5/00* (2013.01); *F25B 5/04* (2013.01); *F25B 40/00* (2013.01); *F25B 41/06* (2013.01); *F25B 41/062* (2013.01); *F25B 2600/2513* (2013.01); *F25B 2700/2103* (2013.01); *F25B 2700/21151* (2013.01)

(58) Field of Classification Search

CPC ..... F25B 5/00; F25B 5/04; F25B 40/00; F25B 41/06; F25B 41/062

USPC ..... 62/175, 513, 197, 185, 201, 640, 656

See application file for complete search history.

(56) References Cited

U.S. PATENT DOCUMENTS

| | | | | |
|---|---|---|---|---|
| 3,640,086 | A | | 2/1972 | Brody |
| 3,952,533 | A | * | 4/1976 | Johnston et al. ..... 62/115 |
| 4,493,193 | A | | 1/1985 | Fisher |
| 5,150,584 | A | | 9/1992 | Tomasov et al. |

(Continued)

FOREIGN PATENT DOCUMENTS

| | | |
|---|---|---|
| DE | 24 51 361 | 5/1976 |
| DE | 298 00 048 U1 | 4/1998 |

(Continued)

OTHER PUBLICATIONS

International Search Report for PCT/CH2004/000046, dated Jan. 24, 2005.

*Primary Examiner* — Frantz Jules
*Assistant Examiner* — Azim Abdur Rahim
(74) *Attorney, Agent, or Firm* — The Webb Law Firm

(57) ABSTRACT

The invention relates to a method for operating a refrigerating installation, according to which the cooling liquid temperature is controlled and stabilized upstream of the expansion valve, and the suction vapor temperature is controlled and stabilized upstream of the condenser in dry expansion systems, thermosyphon installations, two-stage evaporation installations, dry expansion installations having a downstream internal heat exchanger (IWT), and all other refrigerating systems.

5 Claims, 7 Drawing Sheets

(56) References Cited

U.S. PATENT DOCUMENTS

| | | | | |
|---|---|---|---|---|
| 5,533,352 | A | 7/1996 | Bahel et al. | |
| 5,921,092 | A * | 7/1999 | Behr et al. | 62/81 |
| 5,970,732 | A * | 10/1999 | Menin et al. | 62/201 |
| 6,116,035 | A * | 9/2000 | Tanaka et al. | 62/175 |
| 6,164,086 | A | 12/2000 | Kita et al. | |
| 6,170,270 | B1 * | 1/2001 | Arshansky et al. | 62/81 |
| 6,216,481 | B1 * | 4/2001 | Kantchev | 62/238.7 |
| 6,293,123 | B1 | 9/2001 | Iritani et al. | |
| 6,330,802 | B1 | 12/2001 | Cummings | |
| 6,425,262 | B1 * | 7/2002 | Pomme | 62/511 |
| 6,438,978 | B1 | 8/2002 | Bessler | |
| 6,446,450 | B1 | 9/2002 | Pressler | |
| 7,574,874 | B2 * | 8/2009 | Aflekt et al. | 62/513 |

FOREIGN PATENT DOCUMENTS

| | | |
|---|---|---|
| EP | 0 325 163 | 7/1989 |
| EP | 1 043 550 | 10/2000 |
| WO | WO 03/051657 | 6/2003 |
| WO | WO 2004/053406 | 6/2004 |
| WO | WO 2005/073645 | 8/2005 |

* cited by examiner

METHOD OF OBTAINING STABLE CONDITIONS FOR THE EVAPORATION TEMPERATURE OF A MEDIA TO BE COOLED THROUGH EVAPORATION IN A REFRIGERATING INSTALLATION

BACKGROUND OF THE INVENTION (1) Field of the Invention

Systems producing cold conditions in cooling and freezing installations, refrigeration, refrigerating machines for cooling and heating operation, refrigerating installations, refrigerating units, heat pumps, air-conditioning systems and so on.

(2) Description of the Related Art

Known forms of refrigeration are, firstly, dry expansion operation, in which the refrigerant undergoes a pressure reduction via an expansion valve and is transformed from the liquid state into a liquid/vapor mixture and then to evaporate completely into a vapor in the evaporator, to then leave the evaporator with slightly superheated vapor. This liquid to vapor transition of the refrigerant cools down a second medium by heat absorption, and, secondly, by a thermosyphon operation, in which the refrigerant is fed via an equalizing and separating vessel to the evaporator in liquid form either by means of gravity or with the aid of a pump. It is quite possible for the vapor to still contain liquid fractions at the evaporator outlet, and so there is generally no superheating of the refrigerant at the evaporator outlet.

Under practical conditions, all of these systems suffer from more or less serious disadvantages, which we eliminate by our invention, and consequently achieve considerable energy and cost savings.

Dry expansion systems have the advantage of a simple type of construction and small refrigerant contents.

The evaporator efficiency is substantially improved by minimizing the evaporator superheating.

For the compressor, however, this is disadvantageous, and correspondingly high superheating provides improved efficiency (improvement in volumetric efficiency, lubrication, etc.).

BRIEF SUMMARY OF THE INVENTION

The point where these two requirements intersect (optimal superheating for the evaporator and compressor, which are conversely optimal) gives the maximum system characteristic (most efficient operation).

Our invention succeeds for the first time in breaking through this dependence between minimal superheating for the evaporator and great superheating for the compressor.

As a result, this achieves the effect of operating the process for a given refrigerating output Qo with the smallest physically possible mass flow required for this, which leads to considerable economic and energy-related advantages.

A first innovation relates to the dry expansion system (6) (1), with a downstream IHE (2) or internal heat exchanger. The IHE (2) provides heat exchange between the refrigerant liquid line upstream of the expansion valve on the one hand and the suction vapor downstream of the evaporator on the other hand. In other words, the downstream (2) provides heat exchange to the two-stage evaporation system (6) (1+2) (a combination of dry expansion system and thermosyphon system, evaporator with IHE) and to further refrigerating installations constructed on this basis.

Depending on operating conditions, relatively great temperature fluctuations on the refrigerant side, upstream of the expansion valve (6) (A) and upstream of the compressor (5) (B), are typical of these prior art systems.

These temperatures of the refrigerant (upstream of the expansion valve (A) and upstream of the compressor (B)) are at present not kept constant or closely controlled.

Often only the high or suction pressure (Pc/Po) is controlled and/or kept constant, if that.

This leads to more or less great fluctuations and feedback effects (hunting) of the refrigerating system, and consequently, this leads to losses in efficiency and unstable control loops.

The main factors for these fluctuations are, on the one hand, the changed saturation level (x value) of the refrigerant in the expansion valve (6) and in the beginning of the evaporator (1). The saturation level is changed with the changed temperature of the refrigerant (A). The x value is the value that indicates the proportion of already evaporated refrigerant at the beginning of the evaporation process). This saturation level has effects on the performance of the expansion valve (6) and the evaporator (1) and on the control response of the expansion valve (6) and its performance, or the delivered mass flow of refrigerant. The main factors for these fluctuations are, and on the other hand, the suction vapor at the inlet into the compressor (5), where the changed temperature (B), because of the specific volume assigned to the respective temperature (and pressure), has an influence on the volumetric delivery of the compressor (5), that is in turn the delivered mass flow.

These mass flows, constantly changing as a result of temperature changes, introduce greater or lesser disturbing factors into the control loop of the refrigerating installation, which lead to fluctuations in the process, and consequently to reductions in performance efficiency.

The objective of the invention is to improve the performance efficiency and stable operation for cooling/freezing installations, refrigerating machines for cooling and heating operation, refrigerating installations, refrigerating units, heat pumps and all installations that use refrigerants and refrigerating media.

Stable operation of the installation is achieved by the following features:

Firstly, the temperature of the refrigerant upstream of the expansion valve (6) (A) is kept constant at a defined temperature value (A).

Secondly, the temperature of the refrigerant upstream of the compressor (5) (B) is kept at a defined temperature value (B).

Thirdly, these two measures are used on their own or in combination with each other.

Fourthly, these three measures lead to the objective, in combination with a dry expansion valve control (6), in a conventional fashion on the basis of MSS (minimal stable signal) (P8/T22) with or without the assistance of the ME (internal heat exchanger) (2) for which the temperature is measured downstream of the evaporator (1) (T22/P8) or downstream of the IHE (2) (T23/P9) or for which the temperature (pressure difference measurement) is measured between the liquid line upstream of the expansion valve (6) (T20), or for which the pressure or temperature measurement is measured downstream of one or more of the expansion valve (6) (P7) (T21), the evaporator (1) (P8) (T22), or the IHE (2) (P9) (T23), the so-called two-stage evaporator control (T20/P7) (T20/P8) or (T20/P9). These varibles may also be measured with new expansion valve controls on the basis of the pressure difference (7) over the evaporator (1), the IHE (2), the evaporator and the IHE (1+2) or a corresponding reference variable (for example, accumulator). Additionally, any one of these variables may be used individually.

These measures of keeping the temperature of the refrigerant liquid upstream of the expansion valve constant, and also keeping the temperature of the suction vapor upstream of the compressor constant, two-stage evaporator process (with corresponding control) and/or the pressure difference/level control of the expansion valve lead to stable operation of the refrigerating installations, (even with great changes in output), whether these measures are applied on their own or in any desired combination.

If a two-stage evaporator (1+2) is used here, minimal temperature differences between the medium to be cooled on the one hand (C/D) and the evaporation temperature on the other hand can also be achieved.

This temperature difference may, in any event, be less than the temperature difference if the refrigerant leaves the evaporator (1) "superheated" (P8/T22) in a dry expansion operation.

What is novel about our invention is that the temperature of the liquid refrigerant upstream of the expansion valve is continuously maintained at a predetermined value (A).

The liquid refrigerant may be maintained in this way by various measures. For the sake of simplicity, we describe keeping the liquid refrigerant predetermined value (A) constant by means of a heat exchanger (4) in the refrigerant liquid line upstream of the expansion valve, which keeps the outlet temperature of the liquid refrigerant constant by a second medium. This second medium used for keeping the refrigerant liquid temperature constant may in this case be of any kind desired (gaseous, liquid, etc.).

One possibility for keeping the refrigerant liquid temperature upstream of the expansion valve (A) constant may be through cooling the medium at flow point (D). For example, water, brine, etc., is passed through a heat exchanger (4), in which the refrigerant is conducted in either co-flow, cross-flow or counter flow, etc., on the second side of the heat exchanger.

Other possibilities for stabilizing the refrigerant liquid temperature upstream of the expansion valve (A) may also take place, for example, by means of stores, latent stores, masses of inertia or storage masses (13) or further measures.

The refrigerant liquid temperature upstream of the expansion valve (A) may also be controlled by means of mass flow control of the refrigerant liquid (9) through the IHE (2) or of the suction vapor (12) through the IHE (2), however, depending on conditions, sometimes only partial mass flows flow through the IHE (2).

What is also novel about the invention is that the refrigerant liquid temperature upstream of the expansion valve (6) (A) is kept constant.

What is also novel about the invention is that the refrigerant liquid temperature, especially in the case of the two-stage evaporation process (1+2), upstream of the expansion valve (6) (A) is not only kept constant, but at a very low value, which is close to or on the left-hand limiting curve of the log p-h (pressure-enthalpy) diagram for refrigerants. As a result, the refrigerant therefore enters the evaporator (1) in liquid form as in the case of a thermosyphon system or with minimal vapor content.

What is also novel about the invention is that the refrigerant suction vapor temperature at the inlet into the compressor (5) (B) is kept constant.

This may be analogous to keeping the refrigerant liquid upstream of the expansion valve (6) (A) constant. Heat exchangers or storage masses or masses of inertia are used for keeping the suction vapor temperature constant.

Furthermore, there are refrigerating systems utilizing IHEs (2) (two-stage evaporators, semi-flooded systems) which supercool the liquid refrigerant upstream of the expansion valve (A) and maintain the temperature constant and superheat (B) the suction vapor downstream of the evaporator (1) (2).

Keeping the suction vapor temperature constant may also be performed by means such as external supercoolers (3), which control the refrigerant liquid inlet temperature into the IHE (2) (8) and in this way control the suction vapor temperature from the IHE (2) (B).

Keeping the suction vapor temperature constant may also be controlled by means of mass flow control of the refrigerant liquid (9) through the IRE (2) or of the suction vapor (12) through the IRE (2).

Keeping the suction vapor temperature constant may also be achieved by greater or lesser "flooding" of the IHE (2). However, this is utilized only in the two-stage evaporation process.

The "flooding" of the IHE (2) may in this case take place by means of 1) a temperature control of the suction vapor at the inlet of the compressor (two-stage evaporator control) (T23), 2) level control (7) directly by the evaporator (1), 3) IHEs (2) individually or together or 4) by means of a reference variable such as, for example, the accumulator or by a pressure difference control (7) directly by using the evaporator (1) IHEs (2) individually or together.

All these described measures may be used individually or combined in any way desired.

The invention is substantially based on keeping the refrigerant liquid temperature upstream of the expansion valve (A) and the suction vapor temperature upstream of the compressor (B) constantly at any desired value (within the limits of what is physically possible but as and when required up to the physical limits) by suitable measures.

The constant temperature of the refrigerant at two points in the refrigerating system, in particular, the refrigerant liquid upstream of the expansion valve (A) and suction vapor upstream of the compressor (B), achieves the effect of stable operation. If desired, this may also provide minimal temperature differences between the media to be cooled at the evaporator (1) inlet (C) and outlet (D) on the one hand, and the media evaporation temperature at the inlet (C) and/or the outlet (D) on the other hand).

Figure 1:
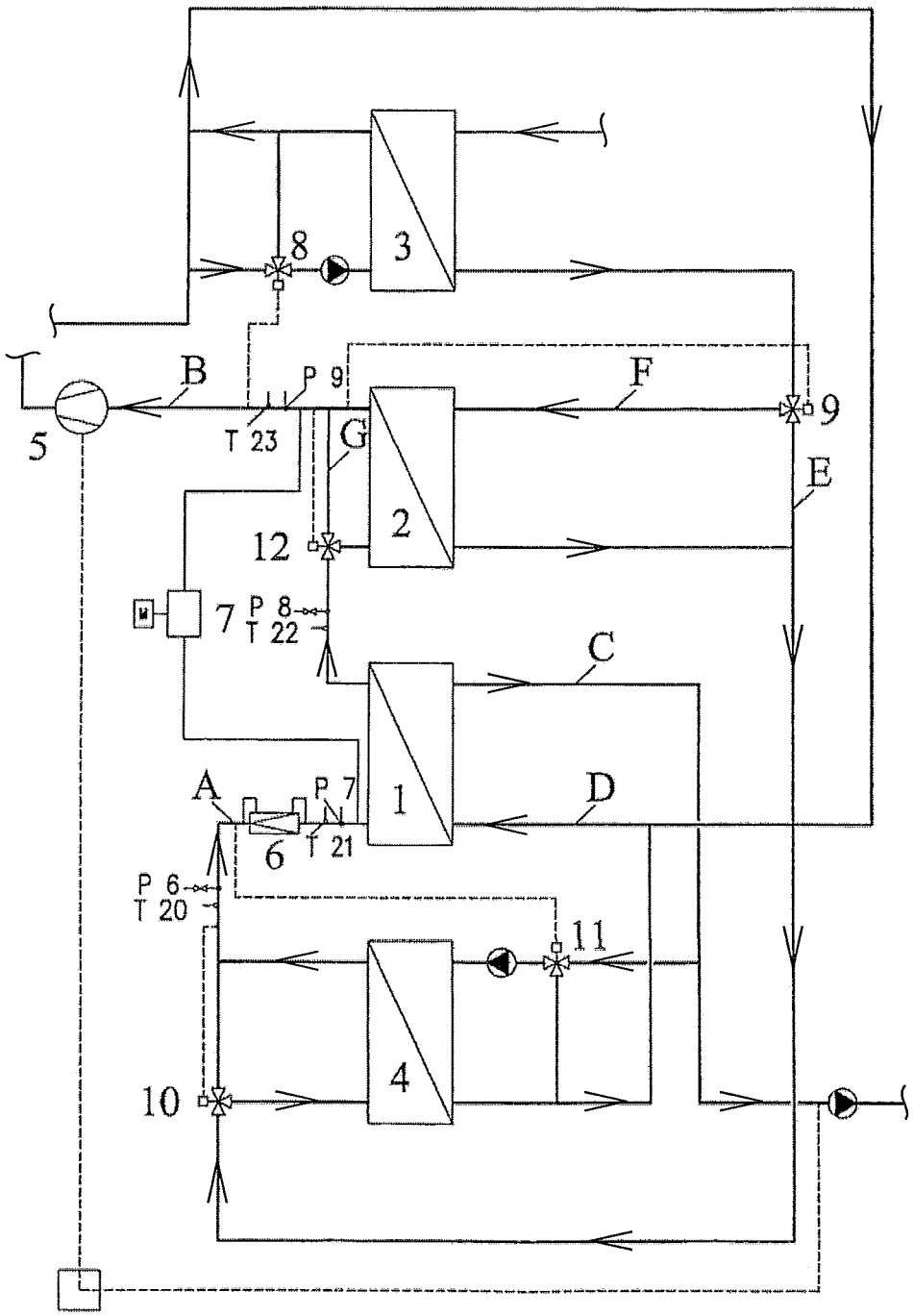
FIG. 1: A schematic of an arrangement showing possible solutions for monitoring the refrigerant temperatures upstream of the expansion valve and compressor.
Figure 2:
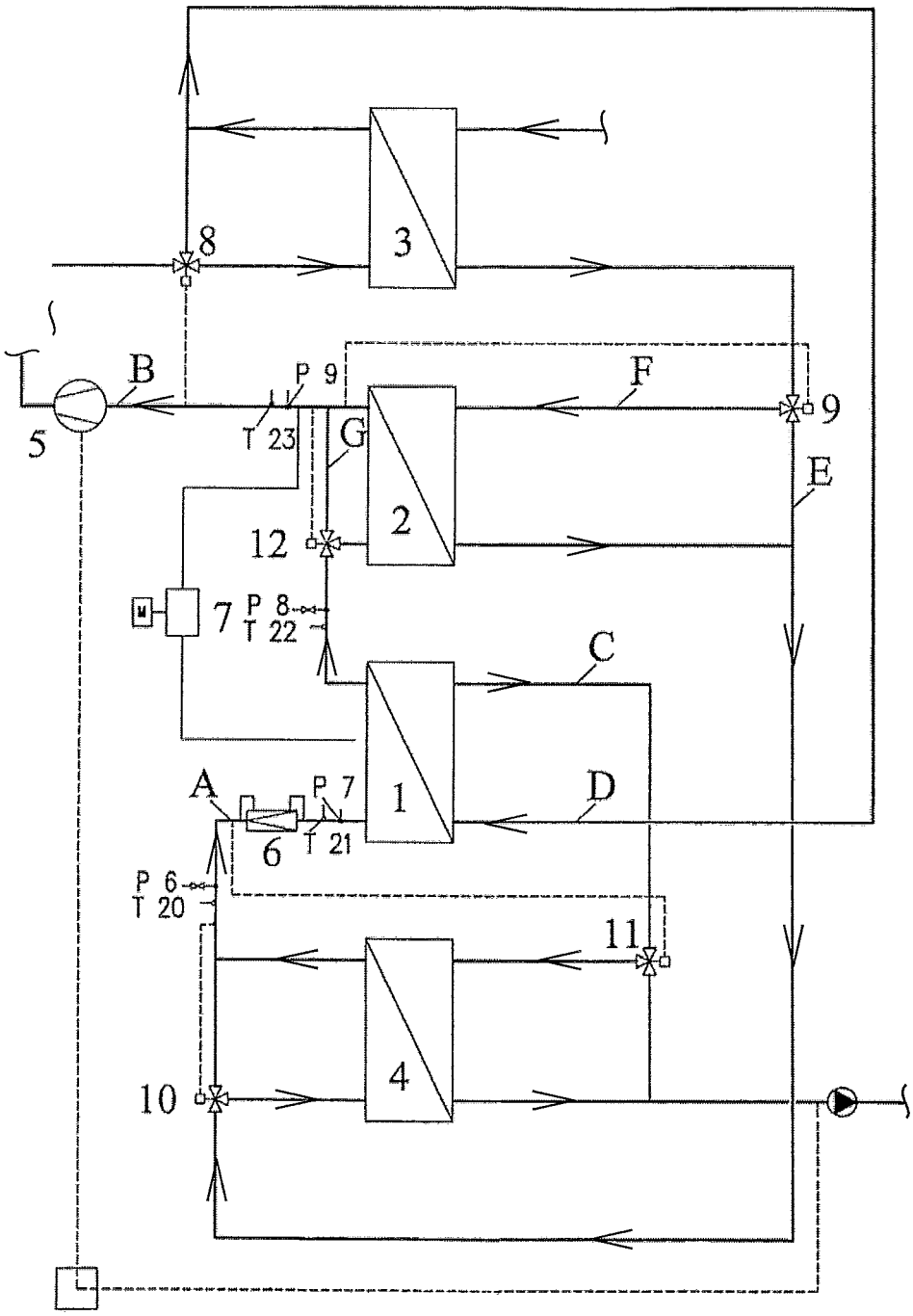
FIG. 2: A schematic of an arrangement showing possible solutions for monitoring the refrigerant temperatures upstream of the expansion valve and compressor without auxiliary pumps in the secondary circuit.
Figure 3:
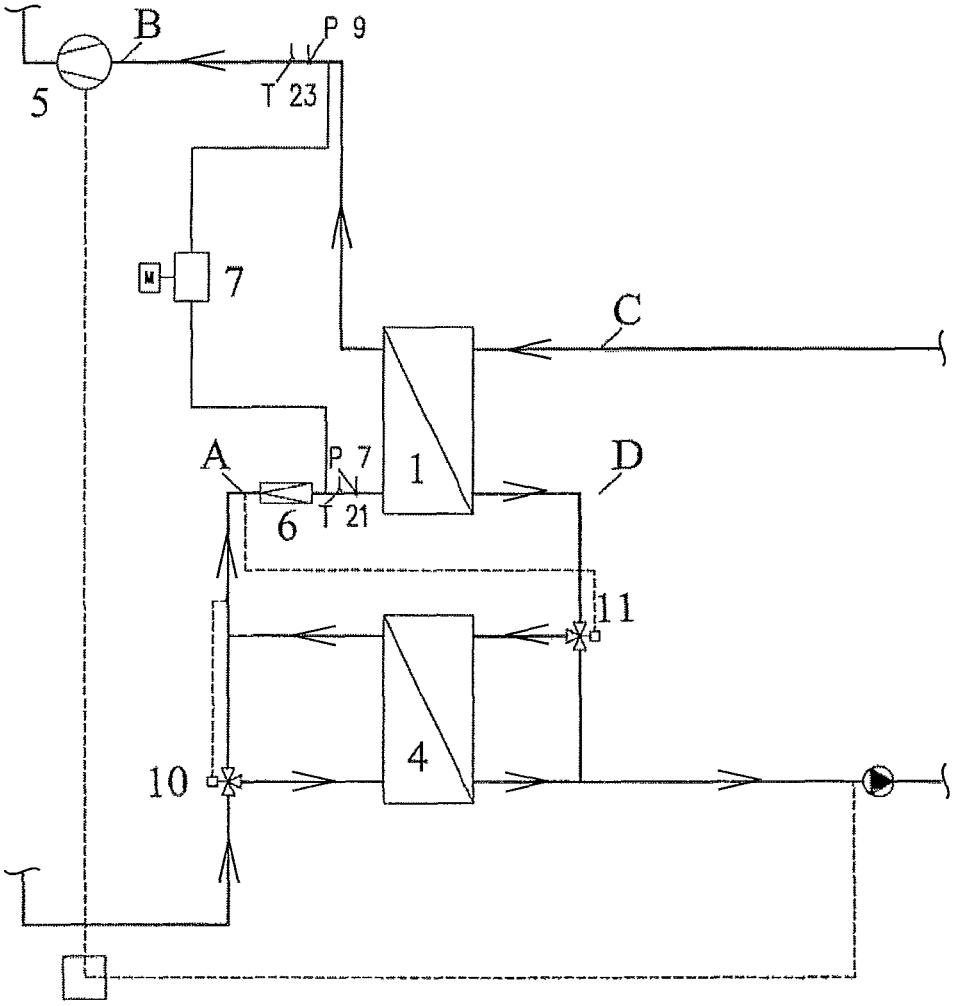
FIG. 3: A schematic of an arrangement showing possible solutions for monitoring the refrigerant temperatures upstream of the expansion valve and compressor in dry expansion operation without the IHE.
Figure 4:
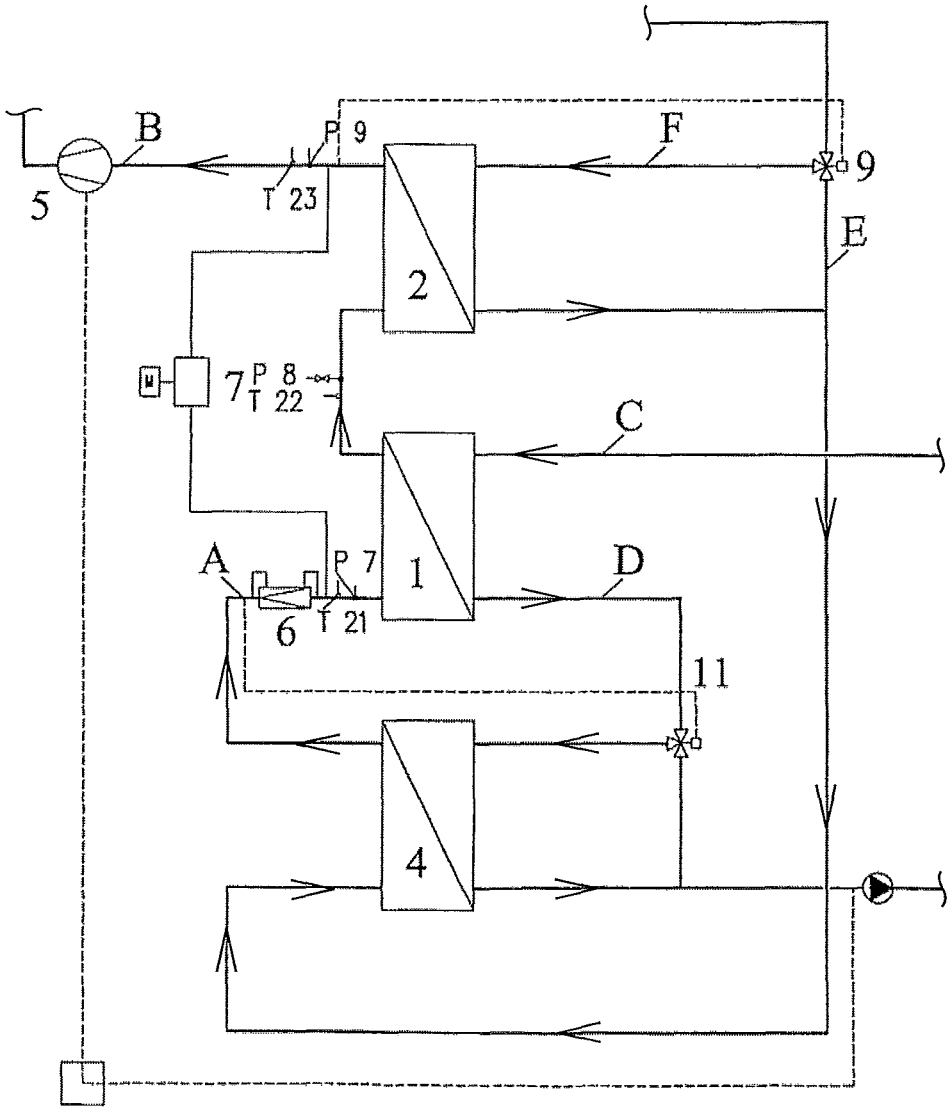
FIG. 4: A schematic of an arrangement showing possible solutions for monitoring the refrigerant temperatures upstream of the expansion valve and compressor in dry expansion operation with IHE and/or two-stage evaporation.
Figure 5:
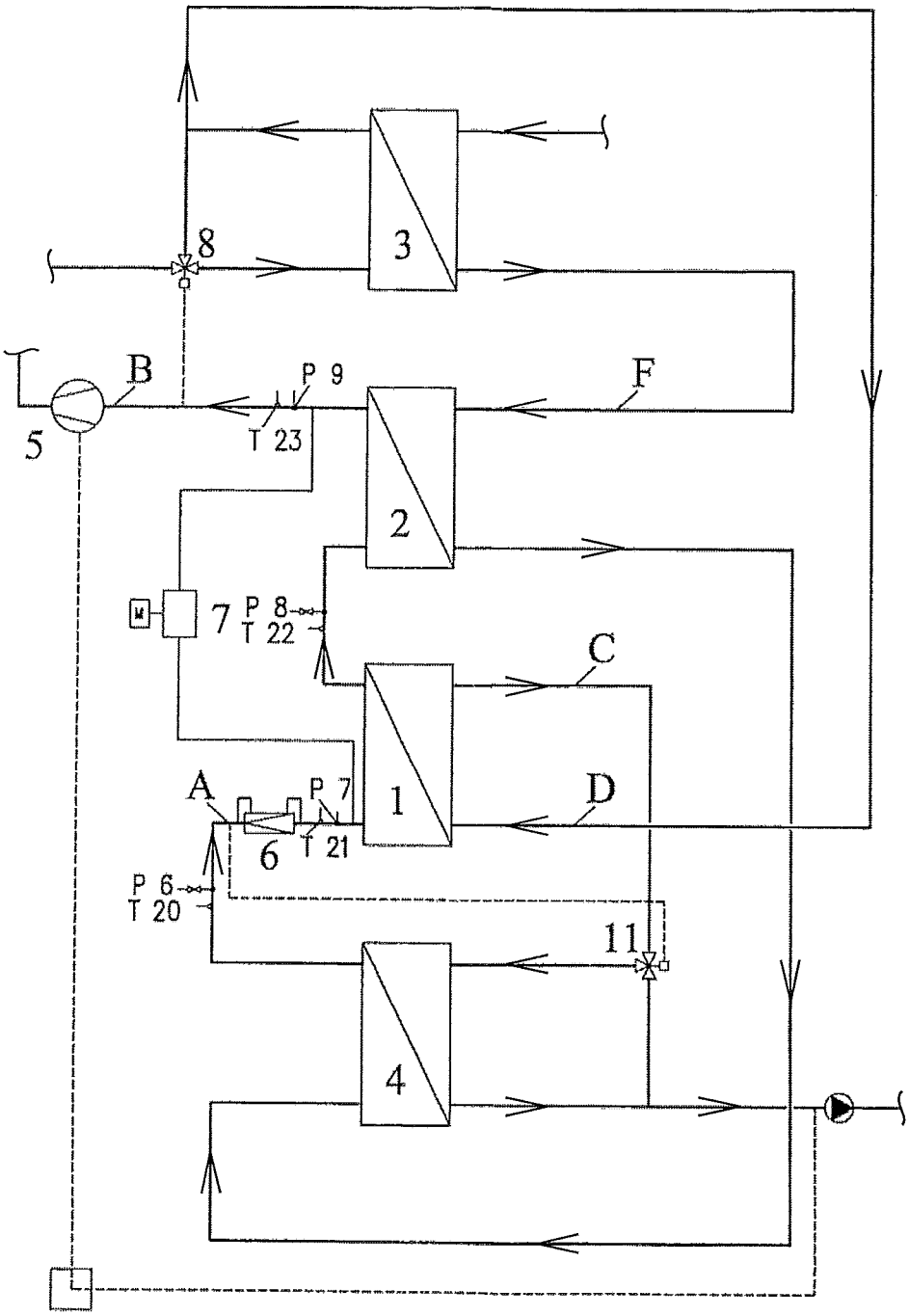
FIG. 5: A schematic of an arrangement showing possible solutions for monitoring the refrigerant temperatures upstream of the expansion valve and compressor in dry expansion operation with IHE and/or two-stage evaporation with external supercooler.
Figure 6:
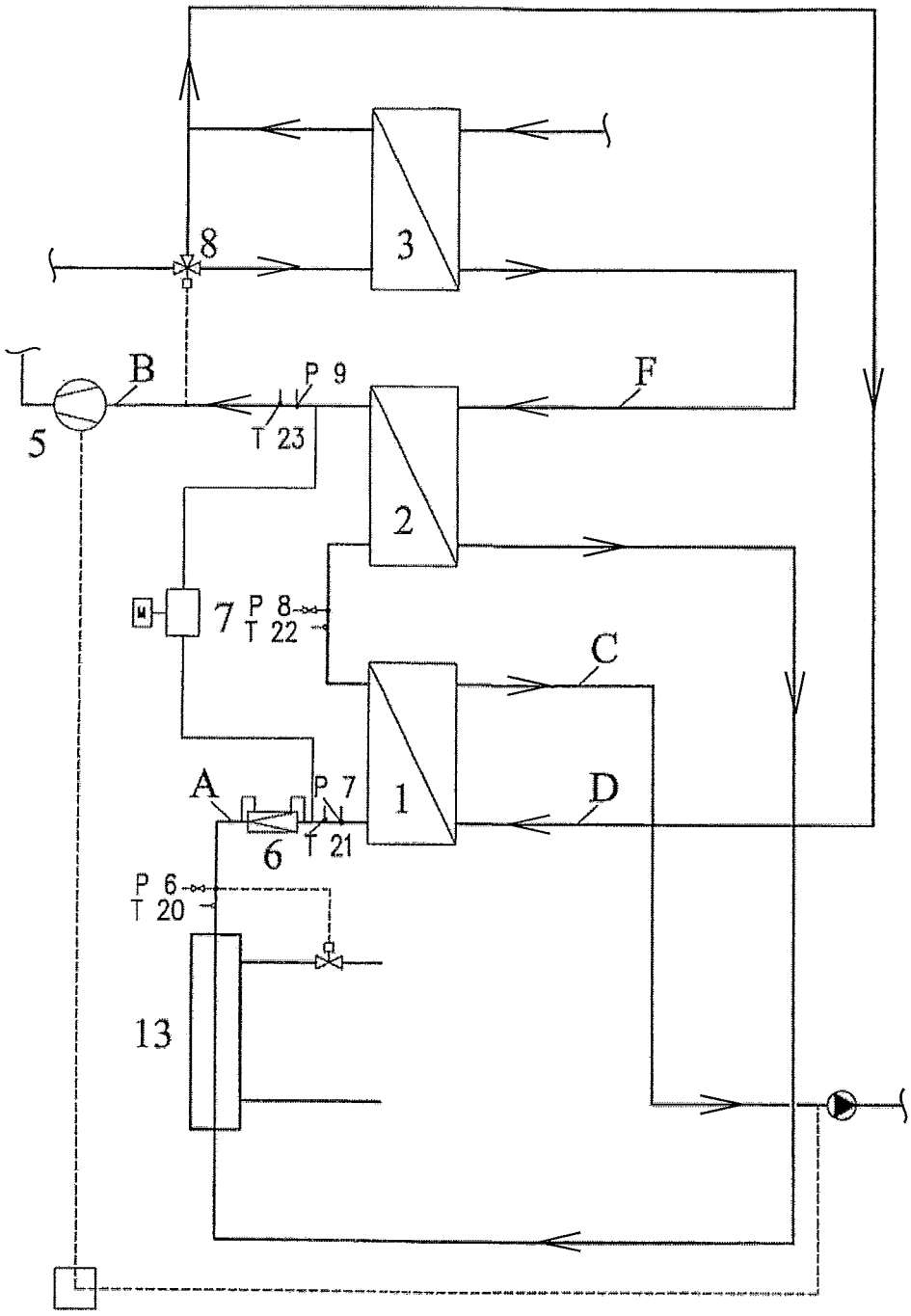
FIG. 6: A schematic of an arrangement showing possible solutions for monitoring the refrigerant temperatures upstream of the expansion valve and compressor in dry expansion operation with IHE and/or two-stage evaporation with external supercooler and storage mass or mass of inertia for keeping constant the temperature of the refrigerant upstream of the expansion valve instead of the heat exchanger.
Figure 7:
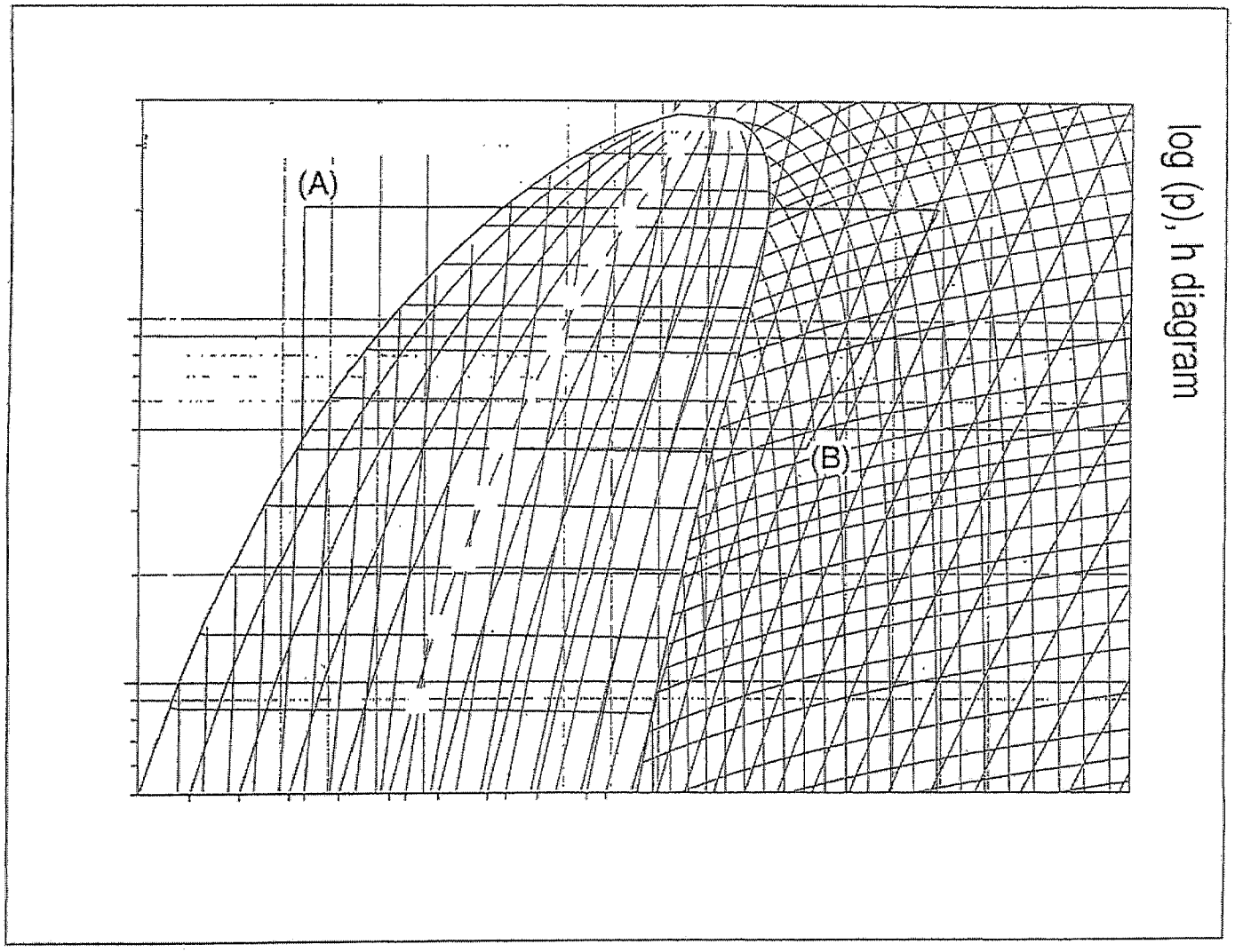
FIG. 7: A pressure-enthalpy (p-h) diagram.

These figures are presented to show illustrative embodiments and are in no way considered to be exhaustive. The valves, heat exchangers, etc. may be used individually or combined in every possible form. No further illustrations are provided and reference is made to the text.

DETAILED DESCRIPTION OF THE INVENTION

The invention is based on achieving stable operation of refrigerating installations with small temperature differences of the media to be cooled, and consequently higher efficiencies. This results in highly efficient evaporation in refrigerating installations.

The method of producing cold conditions is supplemented or modified to the novel extent that, in addition to the monitored suction and high pressures in refrigerating systems, the temperature of the liquid refrigerant upstream of the expansion valve (A) and the temperature of the suction vapor upstream of the compressor inlet (B) is monitored, controlled and kept constant.

Monitoring the refrigerant temperature upstream of the expansion valve (A) allows control of the saturation states in the refrigerant mixture (liquid/vapor). This control in the refrigerant leads to stable conditions in the refrigerating circuit.

The same effect may be achieved by monitoring the temperature and keeping constant the suction vapor temperature at the compressor inlet (B).

By stabilizing these two temperatures, which are the temperatures upstream of the expansion valve and the temperature at the inlet of the compressor, and the associated respective states of the respective refrigerant at these two points in the refrigerating circuit, we achieve stable conditions and prevent feedback effects in the control equipment and hunting of the system. As a result, there are fewer disturbances, which leads to a stable control loop and consequently to stable operation of the refrigerating installations and to highly efficient evaporation.

Such a stable operation has the effect of producing energy and cost savings and making it possible to operate processes with much smaller temperature differences of the media to be cooled in relation to the respective evaporation temperatures, especially in combination with the two-stage evaporation technique (1+2).

As a result, processes can be operated in a simple and low-cost manner that is not possible at present in this way.

The temperature A upstream of the expansion valve and the temperature B at the inlet of the compressor and the associated refrigerant states can be monitored and stabilized in many possible ways.

The enumeration of possibilities is analogously restricted in this patent specification to just a few.

The innovation is the monitoring of the two described refrigerant states (A+B). Irrespective of the method by which this is achieved, only one or the other measure (temperature A, temperature B, or pressure differential 7) must be taken, depending on the application. It is consequently possible to arrive at the desired result just by the monitoring of the temperature of the liquid refrigerant upstream of the expansion valve (A) or monitoring the temperature of the suction vapor upstream of the compressor (B) or by the monitoring of the liquid refrigerant pressure upstream of the expansion valve and the monitoring of the temperature of the suction vapor (A+B).

Suitable measures for monitoring the temperature of the refrigerant upstream of the expansion valve are:

1. Keeping the temperature of the refrigerant upstream of the expansion valve constant by using a secondary medium through a heat exchanger (4).
2. Keeping the temperature of the liquid refrigerant upstream of the expansion valve constant (slow to react) by using a mass (13) which may be liquid, solid, gaseous or mixed between these states of aggregation.
3. Keeping the temperature of the liquid refrigerant upstream of the expansion valve constant, especially when using an IHE or applying the two-stage evaporation process, through use of a control valve (9). This control passes only a specific mass flow through the IHE or the second stage of the two-stage evaporation and the remaining mass flow (E) passes directly or indirectly to the expansion valve. Therefore, it is possible for the mass flow (E) to pass the IHE or the second stage of the two-stage evaporation to be cooled, heated or kept at the same temperature.

Suitable measures for monitoring the temperature of the refrigerant upstream of the compressor are:

4. Keeping the temperature of the suction vapor upstream of the compressor (B) constant by using a secondary medium by means of a heat exchanger.
5. Keeping the temperature of the suction vapor upstream of the compressor constant (slow to react) by using a mass (liquid, solid, gaseous or mixed between these states of aggregation).
6. Keeping the temperature of the suction vapor upstream of the compressor constant, especially when using an IHE or applying the two-stage evaporation process, by means of a control valve (8), (12) and/or (9). Control valves 9 and 12 pass only a specific mass flow through the IHE (2) or the second stage of the two-stage evaporation and the remaining mass flow (9) travels directly or indirectly to the expansion valve (6) or compressor (5).
7. By means of a monitored inlet temperature (F) of the liquid refrigerant into the IHE (2) or the second stage of the two-stage evaporator, for example using an external refrigerant liquid supercooler (3) or the like.
8. By means of a monitored filling level of the refrigerant to be liquefied in the evaporator or in the IHE or in the second stage of the two-stage evaporator, for example by means of level control (7) or pressure difference measurement (7) or suction vapor temperature control (T23) upstream of the compressor. Therefore, it is possible for the level control to occur by means of the evaporator, the IHE or the second stage of the two-stage evaporator individually and/or the evaporator alone or in combination with the IHE or by means of the second stage of the two-stage evaporator or a reference object, for example an accumulator.
9. Especially in the case of a refrigerating system with two-stage evaporation (1+2), the control can be performed as follows (combinations and variants thereof are also possible): expansion valve may be controlled bydetecting the temperature of the refrigerant 1) upstream of the expansion valve (T20), the pressure/temperature downstream of the expansion valve (T21/P7), 2) the pressure/temperature between the first and the second evaporator stages (P8/T22), or 3) the pressure/temperature downstream of the second evaporator stage (P9/T23) or combinations thereof. The temperature/pressure difference (T20/P7, P8, P9) serves as a controlled variable for the expansion valve (6).

A suction vapor temperature detection (T23) upstream of the compressor (5) overrides the temperature difference/pressure control (T20/P7, P8, P9) as required. As an alternative to the temperature difference/pressure control, a level or pressure difference control (7) for the expansion valve (6) may be used.

The temperature upstream of the expansion valve is kept constant by means of suitable measures as already described. Keeping the temperature of the liquid refrigerant upstream of the expansion valve constant in this way may take place for example by using a heat exchanger (4) fitted between the liquid line and the medium flow.

A partial mass flow or the entire mass flow of the cooled medium is conducted (10/11) through the heat exchanger (4) in co-flow, counter-flow or cross-flow, etc., in relation to the refrigerant liquid.

The medium may in this case be conducted through the exchanger with a controlled or uncontrolled temperature.

The correct dimensioning of the heat exchanger (4) has the effect that the refrigerant liquid upstream of the expansion valve (A) is supercooled or kept constant at any desired temperature level, or if desired even at a very low temperature level, which means that the evaporator (1) is fed with liquid refrigerant or with only a small proportion of vapor refrigerant.

The proportion of vapor refrigerant in the evaporator can be optimized and set to the evaporator type (1), and consequently will influence the efficiency for starting the evaporation process, with a corresponding temperature of the liquid refrigerant upstream of the expansion valve (A).

As an alternative to overriding the expansion valve control, based upon the suction gas temperature, by flooding the second stage of the two-stage evaporator, in the case of excessive suction vapor temperatures upstream of the compressor (T23), the refrigerant liquid inlet temperature into the second evaporator stage (IHE) (2) (F) may be limited for example by means of an external supercooler (32). This may be applied in cases of high condensation temperatures.

As an alternative or in combination with this limitation, part of the refrigerant liquid mass flow (E) may be conducted past the second compressor stage (IHE) (2), in dependence on the suction vapor temperature (B).

The invention claimed is:

1. A method for operating a refrigeration plant, in a refrigeration mode, which comprises in a refrigeration circuit a compressor, a condenser, an expansion valve with an entrance and an exit, and an evaporator, the evaporator having a primary side and a secondary side, the evaporator being passed through on said secondary side by a secondary medium to be cooled down, whereby a heat exchanger is provided between an inlet line for the secondary medium and a refrigerant line leading from said expansion valve, such that said heat exchanger is positioned directly upstream of the entrance of said expansion valve, and whereby the method is comprised of the step of keeping constant the temperature of the refrigerant at the entrance of the expansion valve, thereby achieving a stable operation of and hence a highly efficient evaporation in the refrigeration circuit and whereby the temperature of the refrigerant at the entrance of the expansion valve is kept constant by at least partially passing a mass flow of the secondary medium after being cooled down in the evaporator through the heat exchanger in parallel or counter-flow or cross-flow with respect to the refrigerant flow by means of a first valve.

2. The method according to claim 1, further including the step of passing the refrigerant leaving said evaporator through an internal heat exchanger, which may operate as a second evaporating means.

3. The method according to claim 2, whereby, by means of a second valve provided between said refrigerant line leading to said expansion valve and said internal heat exchanger, further including the step of passing a predetermined part of the refrigerant mass flow through said internal heat exchanger, while the remaining mass flow is directly conducted to said expansion valve, to additionally keep the temperature of the refrigerant at the entrance of the expansion valve constant.

4. A refrigeration plant for conducting the method according to one of the claims 1, 2, and 3, whereby said refrigeration plant comprises in a refrigeration circuit a compressor, a condenser, an expansion valve with an entrance and an exit and an evaporator having a primary side and a secondary side, wherein the evaporator being passed through on said secondary side by a secondary medium to be cooled down, whereby a heat exchanger is provided between an inlet line for the secondary medium and a refrigerant line leading from said expansion valve, wherein the heat exchanger is passed through by said refrigerant on the primary side of the heat exchanger, and by said cooled-down secondary medium on the secondary side of the heat exchanger, and a first valve is arranged at the secondary side of said heat exchanger, said first valve being controlled by a temperature of the refrigerant at the entrance of the expansion valve, such that a mass flow of said cooled-down secondary medium is at least partly passed through said heat exchanger in parallel or counter-flow or cross-flow with respect to the refrigerant flow.

5. The refrigeration plant according to claim 4, whereby the refrigerant leaving said evaporator is passed through an internal heat exchanger, and whereby a second valve is provided between said refrigerant line leading to said expansion valve and said internal heat exchanger, such that a predetermined part of the refrigerant mass flow is passed through said internal heat exchanger, while the remaining mass flow is directly conducted to said expansion valve.

* * * * *